United States Patent [19]

Kimbel et al.

[11] Patent Number: 4,974,824

[45] Date of Patent: Dec. 4, 1990

[54] METHOD OF DISTRIBUTING A NEWSPAPER WITH INSERTS

[75] Inventors: Charles W. Kimbel, Bethlehem, Pa.; Edwin Yeoman, West Chazy, N.Y.

[73] Assignee: AM International Incorporated, Chicago, Ill.

[21] Appl. No.: 927,537

[22] Filed: Nov. 6, 1986

[51] Int. Cl.[5] ..... B65H 39/02; B65B 9/02

[52] U.S. Cl. ..... 270/58; 53/553

[58] Field of Search ..... 270/54, 58, 8; 493/386; 53/553, 463, 493

[56] References Cited

U.S. PATENT DOCUMENTS

| | | | |
|---|---|---|---|
| Re. 29,105 | 1/1977 | Miaskoff et al. . | |
| 658,209 | 9/1900 | Firm | 270/8 |
| 3,028,294 | 4/1962 | Histed | 156/515 |
| 3,357,151 | 12/1967 | Monaghan | 53/553 X |
| 3,411,263 | 11/1968 | Smolderen | 53/553 |
| 3,604,182 | 9/1971 | Jepsen | 493/386 |
| 3,633,333 | 7/1972 | Schlemmer | 53/553 |
| 3,782,067 | 1/1974 | Smolderen | 53/553 |
| 3,825,246 | 7/1974 | Elia et al. . | |
| 3,825,247 | 7/1974 | Fernandez-Rana et al. . | |
| 3,874,649 | 4/1975 | Bryson et al. | 270/55 |
| 3,899,165 | 8/1975 | Abram et al. | 270/58 |
| 3,945,633 | 3/1976 | Knopp . | |
| 4,168,828 | 9/1979 | McLear . | |
| 4,268,344 | 5/1981 | Jones | 53/553 |
| 4,295,643 | 10/1981 | Vega | 270/57 |
| 4,313,288 | 2/1982 | Tassi et al. | 53/553 |
| 4,369,613 | 1/1983 | Gess | 53/553 |
| 4,477,067 | 10/1984 | Wise . | |
| 4,541,333 | 9/1985 | Sillars | 101/76 |
| 4,566,681 | 1/1986 | Bottcher et al. . | |
| 4,641,825 | 2/1987 | Mowrey et al. | 270/53 |
| 4,683,708 | 8/1987 | Linder | 53/553 |
| 4,721,296 | 1/1988 | Mowry | 270/55 |

FOREIGN PATENT DOCUMENTS

| | | | |
|---|---|---|---|
| 0080584 | 6/1983 | European Pat. Off. | 270/55 |
| 2255431 | 5/1974 | Fed. Rep. of Germany | 53/553 |
| 2701251 | 7/1978 | Fed. Rep. of Germany | 53/553 |
| 2726131 | 12/1978 | Fed. Rep. of Germany | 53/553 |
| 2257196 | 8/1975 | France | 53/553 |

*Primary Examiner*—Eugene H. Eickholt

*Attorney, Agent, or Firm*—Tarolli, Sundheim & Covell

[57] ABSTRACT

A method of distributing newspapers includes collating newspaper inserts into separate stacks. The stacks of collated newspaper inserts are wrapped to provide separate wrapped packages. Newspaper news sections are collated into separate groups. The groups of collated newspaper news sections with the wrapped packages of collated newspaper inserts are distributed to customers. The wrapping of the stacks of inserts includes applying plastic sheeting about the stacks, sealing the sheeting applied to the stacks, and severing the sheeting to separate the stacks from one another to provide the separate wrapped packages. The wrapped packages of collated newspaper inserts are stacked together and stored until the time of distribution with the groups of newspapers news sections.

4 Claims, 2 Drawing Sheets

METHOD OF DISTRIBUTING A NEWSPAPER WITH INSERTS

BACKGROUND OF THE INVENTION

1. Field of the Invention

The present invention relates to newspaper distribution. Particularly, the present invention relates to distributing newspaper inserts in a separate wrapped package along with the news sections of the newspaper.

2. Description of the Prior Art

Sunday newspapers for large metropolitan areas typically include a folded outer news section, several folded inner news sections, and a multiplicity of advertising, entertainment and promotional inserts. Such newspapers are ordinarily assembled by newspaper stuffing machines. Two such newspaper stuffing machines are disclosed in U.S. Pat. Nos. 4,168,828 and 4,477,067.

The newspaper stuffing machines include a plurality of fixed feeding stations disposed in a circular array. A plurality of pockets are movable below the feeding stations. At a first feeding station, the outer section is fed from a hopper into each of the pockets. The pockets successively carry the outer sections past subsequent feeding stations. Hoppers feed other news sections and inserts into the open outer section within each pocket. At a delivery station, the assembled newspaper is dropped from each pocket onto a conveyor. The newspapers are carried away by the conveyor for stacking and bundling.

Newspaper stuffing machines can have up to fourteen stations devoted to feeding inserts. However, large metropolitan Sunday newspapers can contain several dozen or more inserts. Therefore, several passes through the stuffing machines, with different inserts being fed at stations in successive passes, is required before assembling of the newspapers is complete. A common practice to aid in assembling the Sunday newspaper is to form a subassembly of all the inserts during slack periods between daily newspaper runs. The subassemblies are stored for later placement into the news sections when the Sunday newspaper is assembled.

Typically, the comics section is used as an outer jacket for this subassembly. The comics section is relatively flimsy and difficulties often arise in assembling, storing and handling such a subassembly. Consequently, a need exists for improvements in assembling large metropolitan newspapers, such as the Sunday edition. Particularly, a need exists for reducing the amount of collating and handling, and thereby the difficulties and costs, associated with assembling the newspapers.

SUMMARY OF THE INVENTION

The present invention provides an improved method of distributing newspapers. Many of the difficulties encountered in handling and storing subassemblies of inserts are avoided with the method of the present invention. Thus, the labor costs involved can be reduced by the newspaper publisher. The method of distributing newspapers of the present invention avoids running the inserts through a conventional stuffing machine, storing the assembled inserts and then placing the assembled inserts in the news sections.

The method of the present invention includes packaging the advertising, entertainment and promotional inserts for large editions of newspapers separately from the traditional news sections. The package of inserts is distributed to each customer along with conventionally collated news sections of the newspaper. An inline arrangement of conventional hopper loaders, insert collating stations, and a wrapping station is used to stack and wrap packages of inserts. The wrapped packages of inserts are stored and then distributed with the collated news sections of the newspaper.

In the preferred embodiment, the improved method of distributing a newspaper includes: collating newspaper inserts together; wrapping the collated inserts to provide a separate wrapped package; collating newspaper sections together; and distributing to a customer the collated newspaper sections and the wrapped package of inserts. The wrapping includes applying plastic sheeting about the collated inserts, and sealing the sheeting around the collated inserts.

Collating the newspaper sections preferably occurs at a time after packaging of the newspaper inserts. The wrapped packages of collated newspaper inserts are stacked and stored until the collated newspaper sections are distributed. During insert collating, the absence of a given one of the inserts in one of the stacks can be sensed and the incomplete stack can be repaired by placing the absent insert on the stack prior to wrapping.

BRIEF DESCRIPTION OF THE DRAWINGS

Further features of the present invention will become apparent to those skilled in the art to which the present invention relates from a reading of the following specification made with reference to the accompanying drawings, wherein.

DETAILED DESCRIPTION OF THE INVENTION

Figure 1:
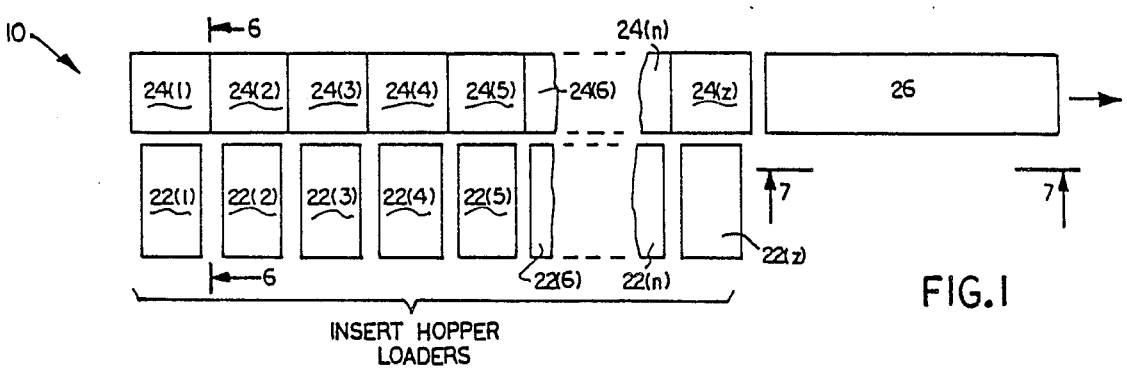
FIG. 1 is a schematic illustration of an apparatus for producing separately wrapped packages of newspaper inserts.
Figure 2:
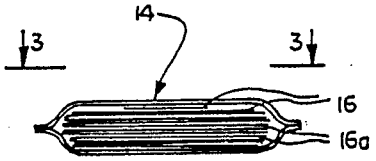
FIG. 2 is a side view of a wrapped package of inserts.
Figure 3:
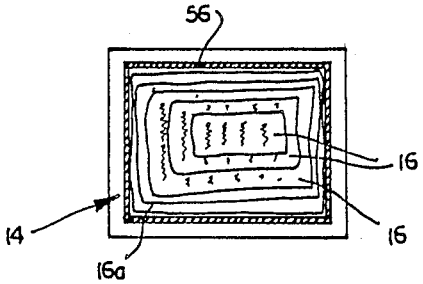
FIG. 3 is a top view of the wrapped package of inserts, taken along the line 3—3 of FIG. 2.
Figure 4:
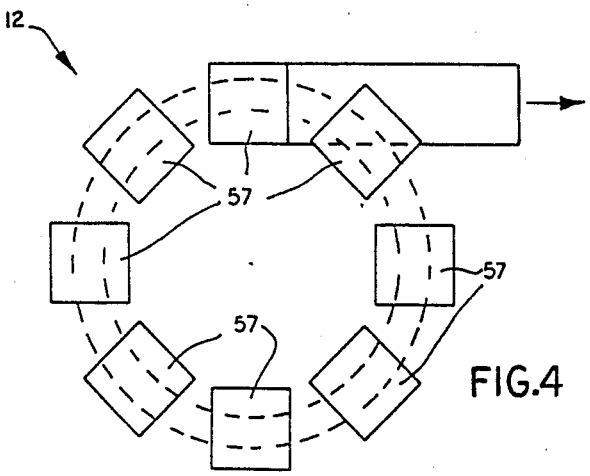
FIG. 4 is a schematic illustration of an apparatus for producing collated newspaper sections.
Figure 5:
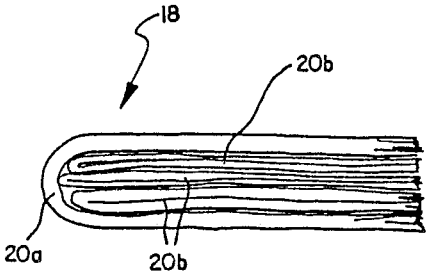
FIG. 5 is a side view of collated newspaper sections.

An inline gatherer and wrapper 10 of the present invention is illustrated in FIG. 1. The gatherer and wrapper 10 produces separately wrapped packages 14 of collated newspaper inserts 16 (FIGS. 2 and 3). A circular newspaper stuffer 12 of the present invention is illustrated in FIG. 4. The stuffer 12 produces separate groups 18 of collated newspaper sections 20 (FIG. 5).

The gatherer and wrapper 10 (FIG. 1) includes a plurality of insert hopper loaders 22(*l*)–22(*n*), a plurality of newspaper inserts collating stations 24(*l*)–24(*n*), and a collated inserts wrapping station 26. The letter "n" can be any number. In the preferred embodiment "n" equals seventy-two. Thus, the gatherer and wrapper 10 has seventy-two collating stations 24 and hopper loaders 22 for collating up to seventy-two inserts in a single stack.

The collating stations 24 of the gatherer and wrapper 10 are of the type disclosed in U.S. Pat. No. 3,825,247 which is incorporated herein by reference. The hopper loaders 22 are of the type disclosed in U.S. Pat. No. 3,945,633 which is incorporated herein by reference.

Figure 6:
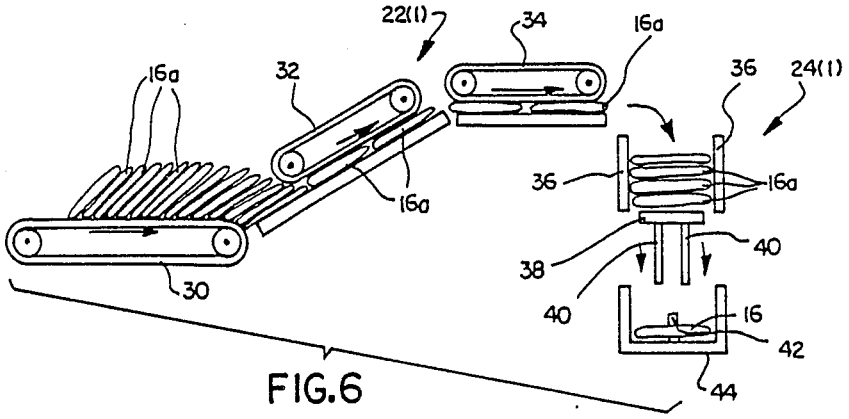
FIG. 6 is a side elevational view of an insert collating station, taken approximately along the line 6—6 of FIG. 1.

The newspaper inserts which are collated into separate stacks 28 by the collating stations 24(*l*)–24(*n*) are typically advertising, entertainment and promotional inserts. These inserts are contained in increasing numbers in the Sunday edition of newspapers in large metropolitan areas. At each of the seventy-two collating stations 24 of the gatherer and wrapper 10, an insert from a bundle is fed to form a stack 28. A bundle of a specific insert 16*a*, as illustrated in FIG. 6, for example the comics page, is placed on a lower horizontal conveyor 30 of the hopper loader 22(*l*). The inserts 16*a* are carried to a first one of the inserts collating stations 24(*l*) by an inclined conveyor 32 to an upper horizontal conveyor 34. The inserts 16*a* are delivered one at a time into a hopper 36 of the first collating station 24(*l*). The inserts 16*a* are dispensed one at a time from the hopper 36 by a separator disc 38 and a pair of transfer drums 40 to successive pockets 42 move in a path on a conveyor 44. The pockets 42 move in a path beneath the collating stations 24.

Figure 7:
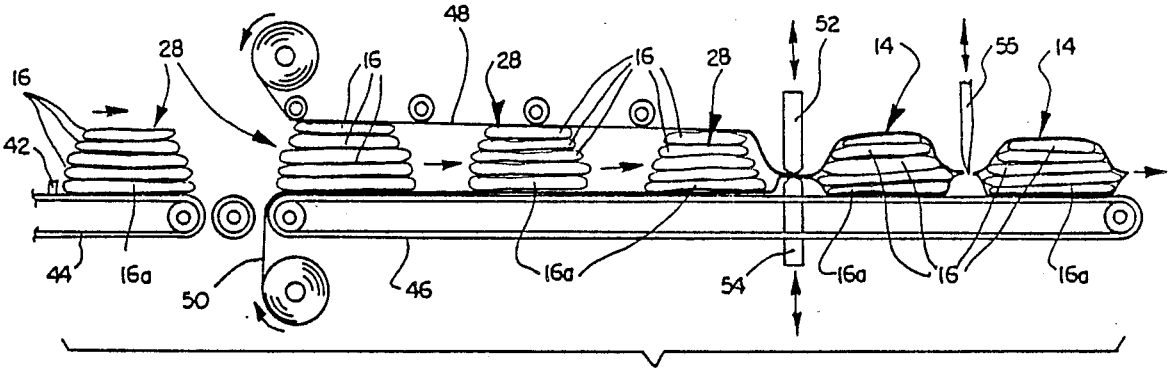
FIG. 7 is a side elevational view of an insert wrapping station, taken approximately along the line 7—7 of FIG. 1.

Each completed stack 28 of collated inserts 16 leaves the collating conveyor 44 and is received on a conveyor 46 of the wrapping station 26, as illustrated in FIG. 7. Wrapping the stacks 28 provides the separately wrapped packages 14 of collated newspaper inserts 16. The successive stacks 28 move between upper and lower webs 48, 50 of plastic sheeting being paid out from supply rolls. Upper and lower vertically movable heated rails 52, 54 seal the plastic sheeting between each stack 28. Similar rails (not shown) seal longitudinally along opposite sides of the stacks 28. Thus, a sealed region 56 (FIG. 3) is formed which completely encircles each stack 28. The transversely extending portions of the sealed regions 56 between each stack 28 are severed by a knife 55 to separate the stacks from one another and provide separately wrapped packages 14.

Figure 9:
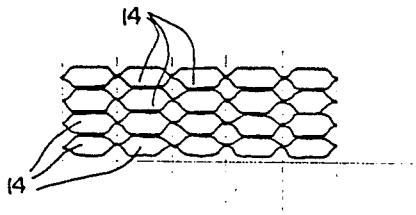
FIG. 9 is a side view of stored wrapped packages of newspaper inserts.

The wrapped packages 14 of collated inserts 16 are then stacked and stored, as illustrated in FIG. 9, until distribution with the groups 18 of newspapers news sections 20. The wrapped packages 14 are slightly compressed during wrapping which tends to form a relatively flat package of inserts. The flat wrapped packages 14 tend to form a relatively stable stack which can be easily stored or further processed into bundles. While wrapping of the stacks 28 with plastic sheeting is illustrated, it should be apparent that alternative wrapping methods could be used, such as binding with plastic strips or twine.

The circular stuffer 12 (FIG. 4) for collating newspaper news sections is a conventional newspaper stuffing machine of the type disclosed in U.S. Pat. No. 4,477,067, which is incorporated herein by reference. Operation of the collating stations 57 of the stuffer 12 in assembling the parts of a newspaper is well known, and will not be described nor illustrated in detail. In the preferred embodiment of the present invention, only the newspaper news sections 20, for example the outer jacket 20*a* and the inside sections 20*b* such as the national, state and local news sections, sports section, and business section, and not the inserts 16, are collated together in the stuffing machine. Collating of the newspaper inner news sections 20*b* with the outer jacket 20*a* preferably occurs at a time after collating of the newspaper inserts 16 has been completed. Thus, the wrapped packages 14 of collated inserts 16 are available for distribution to customers concurrently with the groups 18 of news sections 20 immediately after the news sections have been collated.

Upon delivery of the newspapers to customers, either in residential delivery or in sales at newsstands, each customer is given a wrapped package 14 of collated inserts 16 and a group 18 of collated news sections 20. One package 14 of inserts 16 and one group 18 of news sections 20 comprises the complete newspaper. Receipt of the inserts 16 in the form of the wrapped package 14 is beneficial to the customer since it assures that the customer is receiving all of the valuable discount coupons which are commonly contained in newspapers. The wrapped packages 14 also offer the advantage of being weather resistant because the plastic wrap encapsulates the inserts 16.

Figure 8:
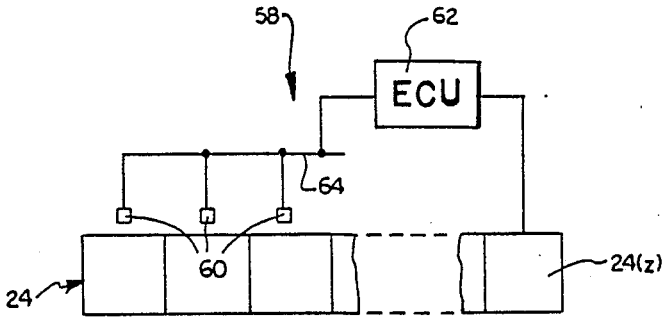
FIG. 8 is a schematic illustration of an insert miss detection and repair system.

An additional feature of the improved method of distributing newspapers is illustrated in FIG. 8. A system, generally designated 58 detects and repairs incomplete stacks 28 of inserts 16. Sensors 60 are associated with each collating station 24 of the gatherer and wrapper 10. The sensors 60 either photoelectrically or electromechanically sense a feed miss of one of the inserts 16 from the hopper 36 to the conveyor pocket 42. Such a feed miss can be repaired in the incomplete stack 28 at a final make-up station 24(*z*) by feeding the absent insert 16, upon actuation of the make-up station, onto the incomplete stack prior to wrapping the stack. While only one make-up station 24(*z*) is illustrated, it will be apparent that more make-up stations can be utilized. Typically, there will be relatively few make-up stations since an additional fee will be charged to an advertiser for achieving a higher degree of accuracy.

An electronic control unit (ECU) 62 processes the information received from the sensors 60 on a common bus 64 and actuates the make-up station 24(*z*) to dispense the make-up inserts. The ECU 62 includes an array of counters (not shown) and is programmed to determine the stations 24 at which a higher degree of accuracy of insert dispensing is desired. When activated by a miss at a collating station 24 at which a repair is desired, a counter counts the number of stations between the miss station and the make-up station 24(*z*). The ECU 62 actuates the make-up station 24(*z*) to dispense the make-up insert on the proper stack 28 to be repaired when the ECU determines that the incomplete stack is below the appropriate make-up station. The ECU 62 can also be programmed to notify an operator if a certain number of misses occurs at any particular collating station 24 so remedial action can be taken.

From the above description of a preferred embodiment of the invention, those skilled in the art will perceive improvements, changes and modifications. Such improvements, changes and modifications within the skill of the art are intended to be covered by the appended claims.

What is claimed is:

1. A method of collating and distributing newspapers including a plurality of different newspaper sections and a plurality of advertising, entertainment and promotional newspaper inserts, the method comprising the steps of:

feeding the advertising, entertainment and promotional newspaper inserts to respective hoppers at respective collating stations of a plurality of collating stations;

moving a collating conveyor having a plurality of separate pockets past the plurality of collating stations;

feeding respective advertising, entertainment and promotional newspaper inserts individually from the respective hoppers at the respective collating stations of the plurality of collating stations to a respective separate pocket of the collating conveyor as the collating conveyor moves past a respective hopper to form a separate group of collated advertising, entertainment and promotional newspaper inserts;

transferring the separate groups of collated advertising, entertainment and promotional newspaper inserts from the collating conveyor to a wrapping conveyor;

moving the wrapping conveyor past a packaging means for wrapping the separate groups of collated advertising, entertainment and promotional newspaper inserts;

wrapping by the packaging means each separate group of collated advertising, entertainment and promotional newspaper inserts as each separate group moves past the packaging means;

storing the wrapped separate groups of collated advertising, entertainment and promotional newspaper inserts;

feeding the different newspaper sections to respective hoppers at respective collating stations of another plurality of collating stations;

moving a collating conveyor having a plurality of separate pockets past another plurality of collating stations;

feeding respective different newspaper sections individually from the respective hoppers at the respective another plurality of collating stations to a respective separate pocket of the collating conveyor as the collating conveyor moves past a respective hopper to form a separate group of collated different newspaper sections; and distributing the groups of collated different newspaper sections with the wrapped separate groups of collated advertising, entertainment and promotional newspaper inserts to a multiplicity of customers.

2. A method as set forth in claim 1 comprising the steps of sensing an insert feed miss at least at some of the respective collating stations of the plurality of collating stations and feeding the missing insert into a respective separate group of collated advertising, entertainment and promotional newspaper inserts at a respective make-up station prior to moving the respective separate group of collated advertising, entertainment and promotional newspaper inserts past the wrapping station.

3. A method as set forth in claim 1 wherein the step of wrapping each separate group of collated advertising, entertainment and promotional newspaper inserts includes the steps of applying plastic sheeting about the separate groups of collated advertising, entertainment and promotional newspaper inserts, moving first heated seal means transverse to the direction of movement of the wrapping conveyor and moving second heated seal means parallel to the direction of movement of the wrapping conveyor to completely seal each separate group of collated advertising, entertainment and promotional newspaper inserts, and severing the plastic sheetings applied to the separate groups of collated advertising, entertainment and promotional newspaper inserts to provide separate completely sealed packages of collated advertising, entertainment and promotional newspaper inserts.

4. A method as set forth in claim 1 wherein the step of moving a collating conveyor past the another plurality of collating stations comprises the step of moving the collating conveyor along a circular path past the another plurality of collating stations arranged in a circular array.

* * * * *